US005307713A

United States Patent [19]

White

[11] Patent Number: 5,307,713

[45] Date of Patent: May 3, 1994

[54] SELF-ALIGNING WRENCH

[76] Inventor: Kenneth L. White, Rte. 1, Box 80, Ferris, Tex. 75125

[21] Appl. No.: 993,373

[22] Filed: Dec. 18, 1992

[51] Int. Cl.[5] ..... B25B 13/58

[52] U.S. Cl. ..... 81/180.1; 81/125; 81/119; 81/121.1; 81/176.1; 81/418

[58] Field of Search ..... 81/180.1, 125, 119, 81/121.1, 176.1, 176.15, 185.2, 186, 418, 419, 124.3, 124.7

[56] References Cited

U.S. PATENT DOCUMENTS

| | | | |
|---|---|---|---|
| 497,797 | 5/1893 | Jones . | |
| 556,443 | 3/1896 | Sprague . | |
| 1,352,461 | 9/1920 | Lenholt . | |
| 1,550,436 | 8/1925 | Hall . | |
| 1,936,352 | 11/1933 | Dixon . | |
| 2,612,068 | 9/1952 | Heumader | 81/119 |
| 2,697,371 | 12/1954 | Bowman | 81/125 X |
| 2,715,347 | 8/1955 | Johnson . | |
| 2,733,937 | 2/1956 | Mowrer, Jr. | 81/124.3 X |
| 3,121,356 | 2/1964 | Davis . | |
| 3,215,009 | 11/1965 | Peterson . | |
| 3,242,775 | 3/1966 | Hinkle . | |
| 3,324,748 | 6/1967 | Williams . | |
| 3,635,262 | 1/1972 | Stebbins | 81/180.1 X |
| 3,858,464 | 1/1975 | Evans | 81/119 |
| 4,227,394 | 10/1980 | Heimel | 76/114 X |
| 4,406,188 | 9/1983 | Mills . | |
| 4,602,536 | 7/1986 | Fish | 81/418 |
| 4,738,168 | 4/1988 | Carminati | 81/125 |
| 4,787,273 | 11/1988 | Griffith | 81/13 |

*Primary Examiner*—D. S. Meislin
*Attorney, Agent, or Firm*—Tom R. Vestal

[57] ABSTRACT

The alignment of nut and bolt tightening wrenches relative to the nut or bolt is resolved in the instant invention by the placement of a protrusion or protrusions on one face of the wrench head. The protrusion, in the preferred embodiment, extends along an axis 90° of the wrench handle to allow for pivoting of the wrench relative to the plane of the nut or bolt head while in use.

10 Claims, 3 Drawing Sheets

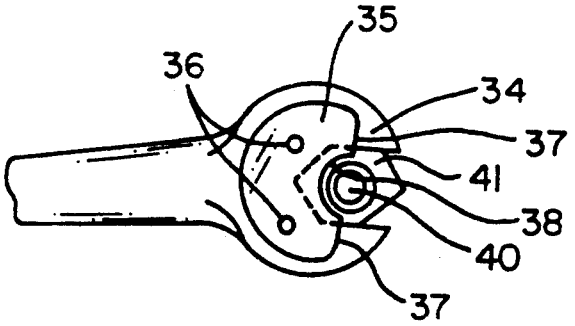
PRIOR ART FIG. 8
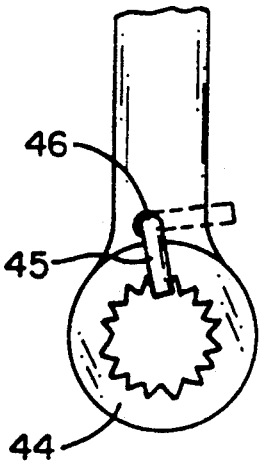
FIG. 9A
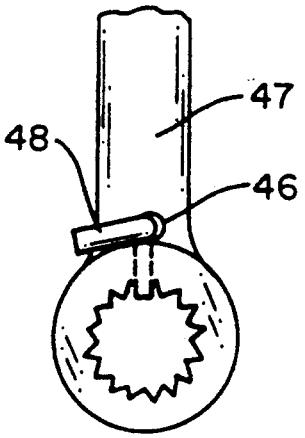
FIG. 9B
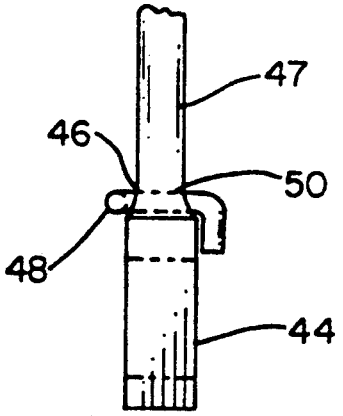
FIG. 9C
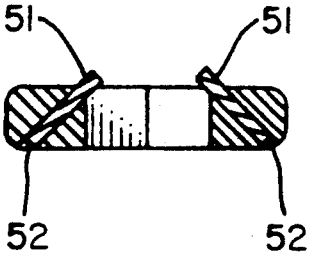
FIG. 10A
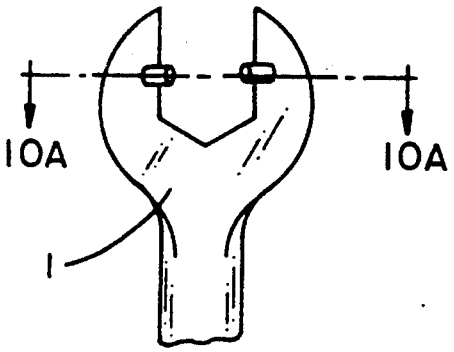
FIG. 10

SELF-ALIGNING WRENCH

BACKGROUND OF THE INVENTION

This invention is directed to wrenches and more particularly to open-end and box end wrenches, adjustable and non-adjustable as well as ratchet type and spanner wrenches. A draw back to end wrenches, both open and closed end is the tendency of the wrench to slip off of the head of the nut or bolt during adjustment. This tendency is especially critical when the wrench is in an odd position or the person using the wrench is positioned awkwardly and has difficulty in reaching the nut or bolt. The user of the wrench is often times given to fumbling with an index finger or use of the other hand to position the head of the wrench while turning the wrench and nut.

A number of prior art references have attempted to solve this problem. For example, U.S. Pat. No. 4,738,168 utilizes a retaining apparatus mounted in the wrench head for holding the nut or bolt in place. The retaining apparatus is secured within the head of the wrench, particularly a box end open or closed end wrench, by small projections that extend approximately 0.003 of an inch into the interior region of the box wrench. The projections are positioned on each side of the wrench head so that the retaining apparatus can slide from one side of the head to the other within the head of the wrench. The difficulty with this wrench concept is that it cannot be used at an angle to the nut or bolt. Secondly, the projections are so small that wear would soon have the retainer lost. Further, the retainer is less than 0.006 inches smaller than the wrench mating surfaces and will have a tendency to bind in the head of the wrench so that its movement from one position to another is impaired.

U.S. Pat. No. 3,121,356 approaches the problem from another angle, in that it has slots built into the center of the wrench to accommodate a bolt and a web that extends to the outer edge of the wrench head, particularly, an open-end wrench, on which the wrench can rest on the top of a nut. The difficulty of this concept is that it requires a rather wide wrench end, and again, the wrench must be used in a flat position.

U.S. Pat. No. 1,764,990 approaches the problem from a different perspective, in that it provides dual webs on each edge of the wrench head, particularly an open-end wrench head, such that the web, in conjunction with the walls of the wrench for contact with the nut form a recess in which the nut fits. The difficulty with this approach is that, again, the wrench must be used in basically a parallel condition with the top of the nut or bolt head; and secondly, it is limited in the size of the nut or bolt that it can engage. For example, the larger "self-locking" nut could not be utilized with this device. A similar approach is found in U.S. Pat. No. 1,936,352. Also U.S. Pat. No. 3,242,775 at FIG. 13 discloses an over hanging section which is brought to bear upon a nut to be tightened down.

U.S. Pat. No. 3,324,748 discloses a "ratchet" device which has an annular ridge inside an elongated face "box end" wrench. This wrench is rather thick and again can only be used with the wrench being substantially parallel to the head of the nut or bolt. The wrench "ratchets" or slips on the nut when filled at an angle (see FIG. 4).

SUMMARY OF THE INVENTION

In the present invention, there is disclosed a self-positioning wrench, i.e., a wrench that will position itself on the head of the nut or bolt for tightening or loosening. The invention is directed to any type of end wrench or spanner wrench, but it works particularly well with open-end wrenches, both adjustable and non-adjustable. The invention comprises the positioning of one or two protrusions on the face of the wrench substantially through the axis of a nut when the nut is positioned within the wrench in a manner for loosening or tightening. The protrusion or protrusions extend inwardly from the wrench head to within a distance "d" of the bolt. The distance "d" does not extend inwardly sufficiently to cause interference with the bolt, but extends sufficiently to rest upon the head of the nut to position it for tightening or loosening. Preferably, "d" ranges from 1/16" to within 1/16" of the bolt thread. The protrusion will, further, extend upwardly in some embodiments so that it will not interfere with the "self-locking" segment of that type nut. Further, the positioning of the projection or projections through an axis 90° to the wrench axis and the axis of the nut or bolt permits the wrench to be canted at an angle (especially in open-end wrenches) during use.

The invention further comprises one or two protrusions extending inwardly along an axis 90° to the wrench axis and substantially through the axis of the nut or bolt head being tightened or loosened. The protrusion extends over one mating surface of the wrench head with a determined bolt to be adjusted. Further, the wrench maybe magnetized to temporarily hold the nut or bolt head in place prior to adjustment.

BRIEF DESCRIPTION OF THE DRAWINGS

For a more complete understanding of the present invention, and the advantages thereof, reference is now made to the following detailed description of the invention taken in conjunction with the accompanying drawings, in which:

FIG. 8 is a prior art depiction;

FIGS. 9A, 9B and 9C depict an embodiment that is reversible;

FIGS. 10 and 10A are a depiction of another embodiment utilizing rods to form the protrusion.

DETAILED DESCRIPTION OF THE INVENTION

The preferred embodiment of the present invention and its advantages are best understood by referring to FIGS. 1 through 10 of the drawings, like numerals being used for like and corresponding parts of the various drawings.

Figure 1:
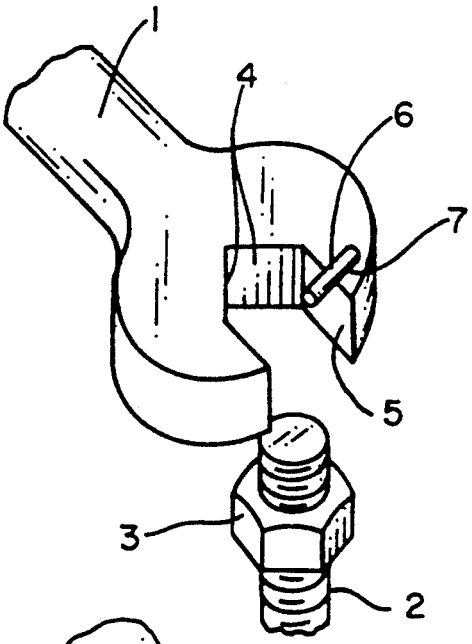
FIG. 1 and FIG. 1A are partial views of an end wrench having one and two protrusions respectively, and in accordance with the invention herein.
Figure 1A:
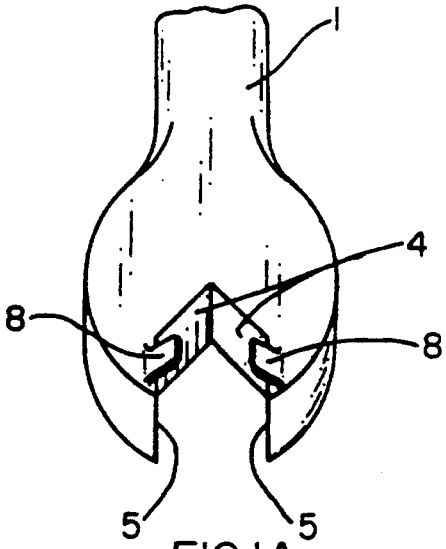

In reference to FIG. 1, one face 1 of an open end box wrench is shown positioned above a bolt 2 and nut 3 thereon. The mating surfaces 4 and 5 of the wrench head are positioned relative to the nut 3. In this embodiment of the invention, a small rod 6 is affixed to the face 1 of the wrench head in a notch 7. The affixation may be by any means which will permanently secure the rod 6 in place, including glue, electric weld, brazing and the like.

Figure 2:
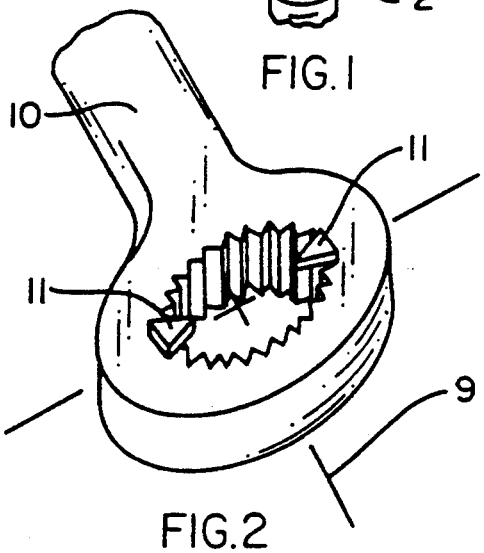
FIG. 2 depicts the end of a box end wrench having two darts in accordance with the invention.

In FIG. 2, the face of an closed end wrench 10 is depicted showing darts 11 affixed to the wrench face on an axis 90° to a wrench axis 9 and through the center of the wrench head. The purpose of the affixation will be explained in more detail relative to FIGS. 5, 5A and 5B.

Figure 3:
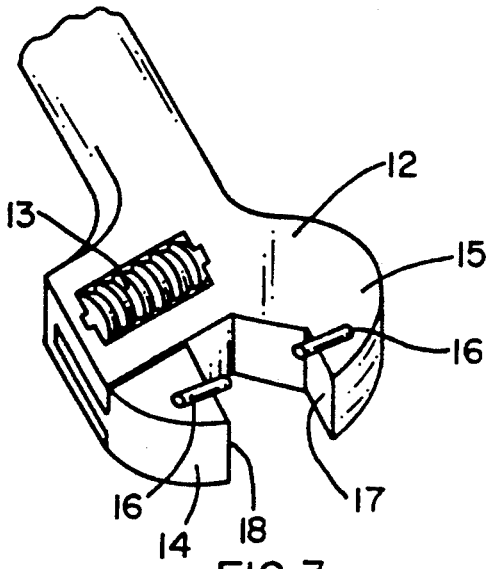
FIG. 3 is an embodiment showing an adjustable end wrench in accordance with the invention.

In FIG. 3, an adjustable end wrench 12 is shown having a fixed jaw 15 and movable jaw 14. The adjustment of the movable jaw 14 is in accordance with a finger adjustment roller 13. Rods 16 on a face of the wrench head 12 of both the movable jaw 14 and fixed jaw 15 are mounted such that a portion of the rod extends over the surfaces 17 and 18 of the fixed and movable jaws 15 and 14 respectively. When the wrench head of FIG. 3 is adjusted correctly and the wrench is positioned on the top of a bolt and nut such as shown in FIG. 1 the wrench will rest on the top of the nut. The length of the rod is such that it will not interfere with the bolt 3.

Figure 4:
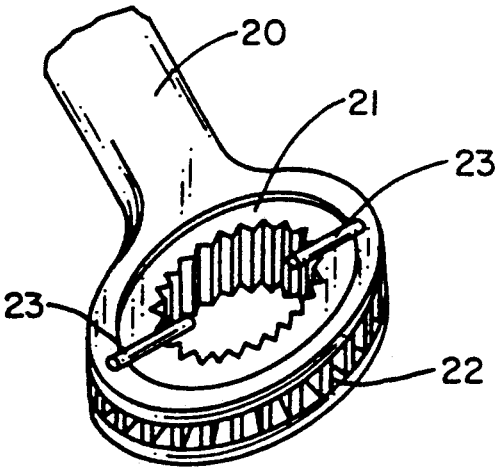
FIGS. 4 and 4A are embodiments of a ratchet wrench.
Figure 4A:
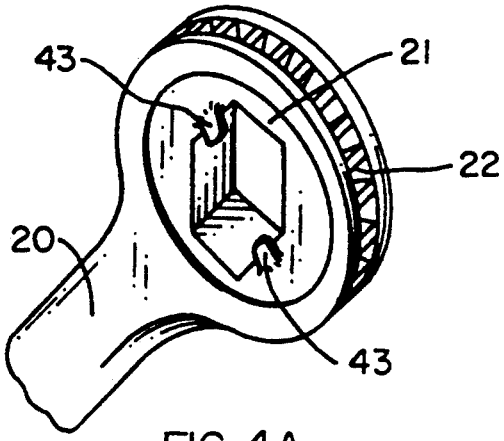

FIGS. 4 and 4A depict ratchet-type end wrenches. In FIG. 4, a ratchet-type end wrench 20 having a recessed wrench head 21 with pawl attachment to engage ratchet wheel notches 22. Rods 23 are affixed to the face of the end wrench 20 and extend inwardly to cover at least a part of any nut.

FIG. 4A protrusions 43 are formed on the face of the rotatable ratchet head 21 during a forging process which shapes head 21.

Figure 5:
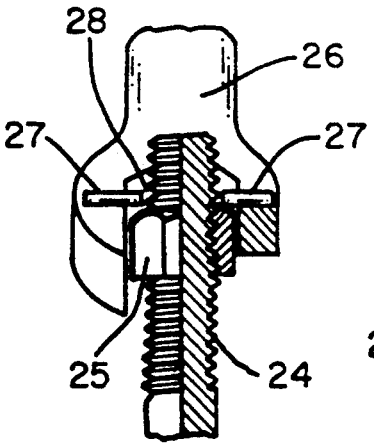
FIGS. 5, 5A and 5B depict the use of the invention herein in an angled position.

The partial sectional view in FIG. 5 of an open-end box wrench 26 having rods 27 affixed on a 90° axis to the wrench axis (see FIG. 2) indicates how the protrusions rest on a nut face 28 of a nut 25 (shown partially screwed onto bolt 24).

Figure 5A:
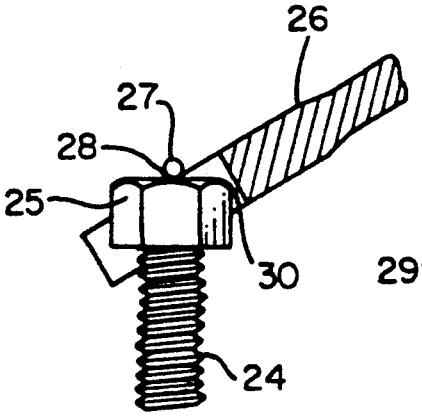

FIG. 5A shows the same wrench head 26 at a 90° angle from FIG. 5 and with the top of the bolt removed to show how the rod 27 rests upon the face 28 of a nut 25. In this particular angle of wrench inclination, the wrench head 26 rests on a contact point 30 between the nut 25 and the wrench 26. In the present invention, the wrench head 26 can be placed casually by the user onto the surface of nut 25 and the wrench will automatically position itself by contact of the rods 27 to the top face 28 of nut 25 and by the contact point 30. The ability of the wrench to operate at an angle is depicted in FIG. 5A where it can be seen and appreciated that the mating surfaces of the wrench head contact a substantial portion of the nut surface, even in the inclined position. Its self-alignment aspects make it easy for the user to reach into a difficult spot and place the wrench in torquing position—even at an angle—and have an effective ability to loosen or tighten the nut as required. Furthermore, the user does not have to be concerned with the wrench slipping off the head of the nut resulting in the infamous "knuckle-busting" characteristics of wrenches of this type.

Figure 5B:
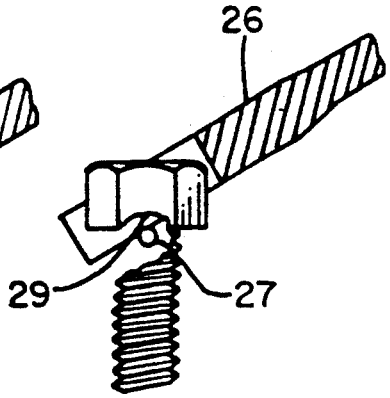

FIG. 5B shows in a cut-way view of how the wrench can be turned upside down and the rod 27 contact the bottom face of the nut 29.

Figure 6:
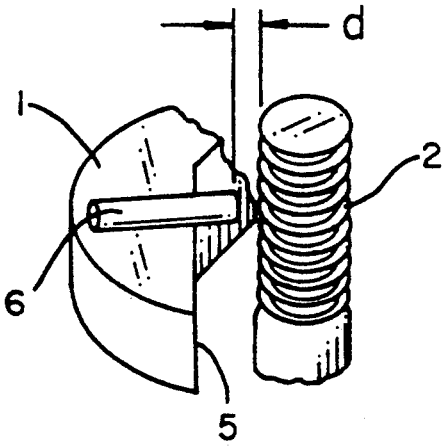
FIG. 6 depicts the relationship of a protrusion in accordance with the invention relative to a bolt head.

FIG. 6 shows the head of a bolt 2 and a partial cutaway of an open-end wrench 1 with a nut engaging surface 5. Rod 6 is attached to the face of wrench 1 and extends across the surface 5 within a distance "d" of the bolt when the wrench is in alignment with a nut 3 (not shown). This distance "d" is critical to the extent only that it not interfere with alignment of the wrench on the bolt, but should extend outwardly a sufficient distance to make solid contact with the face of a standard nut. (As shown, for example, in FIG. 5). The distance "d" and the shape of the protrusion will also be reflected in the use of the wrench on "self-locking" nuts.

Figure 7:
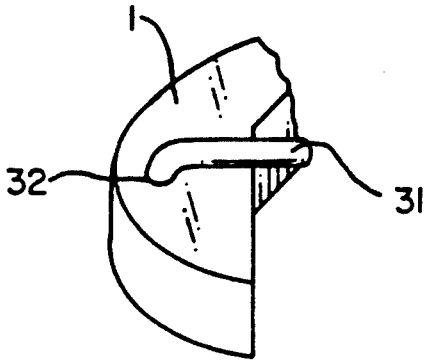
FIGS. 7, 7A and 7B depict an alternative embodiment of the invention.
Figure 7A:
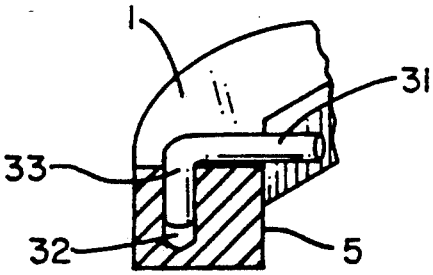

The embodiment of the invention as depicted in FIG. 7 shows a rod 31 inserted into an opening 32 (see FIG. 7A), the lower end 33 of rod 31 inserted into the opening 32 can be affixed by an adhesive welding or other permanent type of affixation.

Figure 7B:
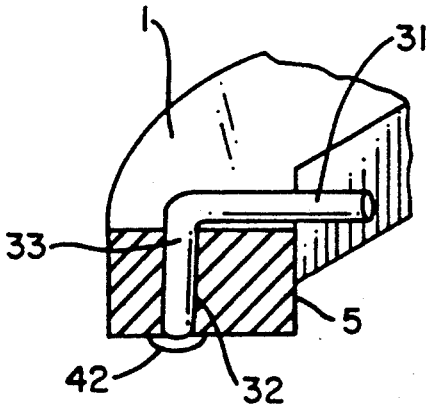

In FIG. 7B the lower end 33 of rod 31 extends through an opening 32 completely through the jaw of wrench 1. The end 42 of rod 31 is then formed by a bradding process to affix the positioning of rod 31 in place. Rod 31 may fit into a notch section similar to that shown in FIG. 1 in order to maintain its alignment with the nut axis.

Shown in FIG. 8 is a prior art device comprising on open end wrench 34. On open end wrench 34 is a plate 35 secured by (in this instance) two brads 36. Edges 37 of plate 35 appear to be substantially on the axis through the bolt at a 90° angle to the end wrench. However, the plate has a clearance segment 38 slightly larger is diameter than the diameter of bolt 40, but less than the diameter of nut 41. In operation of this device, it too must be used substantially co-planar with the face of the nut, otherwise, the plate will interfere with the bolt diameter. FIG. 8 is shown herein as an amalgamation of FIGS. 1, 4, and 6 of the '371 patent. FIGS. 1 and 4 show that the plate 35 may be slidable in and out of position relative to the wrench head. FIG. 3, however, shows that the wrench is used parallel to the face of the nut in contradistinction to the present invention as shown in FIGS. 5 and 5A, for example.

In FIGS. 9A–9C, an alternative embodiment is shown in which a rod 50 (FIG. 9C) extends through an opening 46. The ends of rod 50 are bent an a substantially 90° angle to each other in a manner that one end 45 will extend over the edge of the nut mating surfaces of the end wrench 44 while the other end 48 of the rod 50 will not so extend. When the rod is rotated 90° the positioning of the rods will be reversed. The rod may be so formed that it will be in frictional engagement with the head 44.

In FIG. 10, the embodiment is shown where an end wrench 1 has rods 51 extending through angled apertures 52 through the head of the wrench in a manner that the rods extend upwardly at an angle. This particular embodiment is especially useful for self-locking nuts.

It is recognized in describing the invention herein that the term "wrench axis" is depicted as running substantially along the handle of the wrench. In wrenches of this type which are angled or otherwise have the handle bent other than normal to the wrench head, the term "wrench axis" is intended to be along a phantom line in which the wrench handle would extend if it were in a normal plane.

Although the present invention and its advantages have been described in detail, it should be understood that various changes, substitutions and alterations can be made herein without departing from the spirit and scope of the invention as defined by the appended claims.

What is claimed is:

1. In an end or spanner wrench, including a handle and a head, said head having a plurality of surfaces for mating with a determined size nut or bolt having an outer edge and an inner edge, the axis of the nut or bolt being centered relative to said plurality of mating surfaces and a wrench axis extending along the handle of the wrench and substantially through the nut or bolt axis; the improvement comprising at least one protrusion extending from a face of said wrench head only along substantially an axis line 90° to the wrench axis and partly over the outer edge of said nut or bolt when said nut or bolt is positioned within the plurality of surfaces.

2. The improved end or spanner wrench of claim 1, wherein said protrusion extends along the 90° axis over the outer edge of said nut or bolt head surface, but less than to said nut inner edge.

3. The improved end or spanner wrench of claim 2, wherein said protrusion comprises a dart affixed to the head of said wrench.

4. The improved end or spanner wrench of claim 2, wherein said protrusion comprises a rod affixed to said face of said head.

5. The improved end or spanner wrench of claim 2, wherein, further, said wrench is forge manufactured and said protrusion is formed in the face during the forging process.

6. The process of manufacturing an end or spanner wrench according to claim 1, wherein said protrusion is formed in the head of said wrench during forge manufacture of said wrench.

7. The process of manufacturing an end or spanner wrench of claim 1, wherein said protrusion is formed after the manufacture of said wrench head.

8. The process of claim 7, including the steps of forming an opening in at least one face of the head of the wrench, inserting a rod in the opening and affixing the rod to extend over one nut mating surface.

9. A self-positioning end wrench comprising a head having an upper face and a lower face and a plurality of surfaces for mating with a determined size nut, an aperture in said wrench extending therethrough adjacent said head, and a rod extending through said aperture and configured in a manner that one end of the rod extends across said upper face and at least partially over a mating surface and the other end extends substantially at 90° to said one end along the lower face.

10. The self-positioning end wrench of claim 9, wherein the other rod end extends across said lower face and at least partially over a mating surface upon rotation of said one end substantially 90°.

* * * * *